US006311784B1

(12) United States Patent
Clarke et al.

(10) Patent No.: US 6,311,784 B1
(45) Date of Patent: Nov. 6, 2001

(54) ENERGY STORAGE RIPPING DEVICE

(75) Inventors: Donovan S. Clarke, Hanna City; Andrea R. Vernagus, East Peoria; Timothy A. Vik, Hopewell; William H. Zimmerman, Edelstein, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/589,900

(22) Filed: Jun. 7, 2000

(51) Int. Cl.[7] ..... A01B 63/10; E02F 5/32

(52) U.S. Cl. ..... 172/463; 172/464; 172/484; 172/699

(58) Field of Search ..... lp;1p172/463, 172/ 464, 484, 699, 491, 668, 675, 677, 679, 448, 474, 776

(56) References Cited

U.S. PATENT DOCUMENTS 4,991,659 2/1991 Stepe et al. ..... 172/464

*Primary Examiner*—Christopher J. Novosad
(74) *Attorney, Agent, or Firm*—Robert A. McFall

(57) ABSTRACT

A ripper carriage assembly has a transverse cross beam fixedly mounted at a central portion of the cross beam to a ripper implement support structure. The distal ends of arms extending outwardly from the central portion of the transverse cross beam are adapted for pivotal connection to a pitch control mechanism. Stress relief notches are formed in the transverse cross beam at a position between the distal ends of the arms and the central rigidly mounted portion of the beam. Energy generated as a. result of the ripper tip twisting upon impact with rock or other solid objects in hardened ground is stored in the transverse cross beam, and subsequently returned to the ripper tip to bring the tip into a desired operational orientation.

6 Claims, 3 Drawing Sheets

ENERGY STORAGE RIPPING DEVICE

TECHNICAL FIELD

This invention relates generally to a ripper assembly, and more particularly to a ripper carriage assembly having a means for storing energy generated by twisting forces imposed on a ripper tip during operation in rock and similar hard material.

BACKGROUND ART

Ripper assemblies are commonly used to loosen hardened ground and break up rock formations. In such operations, a ripper shank having a tip mounted on a lower end is pulled, and sometimes additionally pushed, through the ground with sufficient force to break up the hardened ground or rock. Fracture zones in the rock, and large rocks randomly distributed in hardened ground defect the tip away from a true forward direction, imposing significant twisting forces on the tip of the ripper shank. The impact twisting forces imposed on the ripper tip are transmitted through the ripper shank to the structure supporting the ripper implement.

The upper end of ripper implement support structures is generally attached to pitch control cylinders which control the pitch, or attack angle, of the ripper tip with respect to the ground. Repeated severe twisting impact shock forces on the ripper tip adversely affect the integrity of the support structure, to the point that weld joints fail and the ripper assembly becomes inoperable. For example U.S. Pat. No. 4,991,659, issued Feb. 12, 1991 to Visvaldis A. Stepe, et al., for a RIPPER ASSEMBLY WITH PITCH CONTROL AND INTEGRAL FRAME AND PUSH BLOCK, and assigned to the assignee of the present invention, discloses a ripper assembly in which the pitch control cylinders are pivotally attached by universal brackets mounted on the sides of the ripper shank support housing. Repeated twisting impact shock forces on the ripper tooth can cause failure of the welded joint between the universal brackets and the ripper support housing. The present invention is not only directed to overcoming the problems set forth above, but also to providing a ripper assembly capable of storing a portion of the twist forces and use that stored energy to return the tip to its original orientation.

DISCLOSURE OF THE INVENTION

In accordance with one aspect of the present invention, a vehicle having a moveable ripper assembly includes a frame assembly having a first end pivotally em attached to the vehicle, a second end spaced from the first end, and a lift mechanism disposed between the vehicle and the second end of the frame assembly. The vehicle further includes a ripper carriage assembly having an elongated implement support housing adapted to receive the shank of a ripper implement therein, a first end portion pivotally connected to the second end of the frame assembly and a second end portion spaced from the first end portion. A pitch control mechanism is disposed between the vehicle and the ripper carriage assembly. The ripper carriage assembly includes a transverse cross beam having a central portion rigidly mounted on the second end of the support housing. The transverse cross beam has a pair of arms extending respectively outwardly from the support housing, with each of the arms having a distal end portion which has a bracket to which the pitch control mechanism is pivotally connected. Further, the transverse cross beam has a stress relief notch disposed between the central portion and each of the distal end portions of the outwardly extending arms of the transverse cross beam.

In accordance with another aspect of the present invention, a ripper carriage assembly includes a ripper implement support housing having a predefined longitudinal axis, a first end portion having a pivot connection adapted for attachment to a lift mechanism, and a second end spaced from the first end. The ripper carriage assembly further includes a transverse cross beam spaced from the longitudinal axis of the support housing and extending in a direction transverse to the longitudinal axis. The transverse cross beam has a central portion rigidly mounted on the second end portion of the support housing, and a pair of arms extending respectively outwardly from the middle portion. Each of the arms has a distal end and a stress relief notch formed at a position between the distal end of the arm and the middle portion of the transverse cross beam.

BRIEF DESCRIPTION OF THE DRAWINGS

A more complete understanding of the structure and operation of the present invention may be had by reference to the following detailed description when taken in conjunction with the accompanying drawings, wherein.

BEST MODE FOR CARRYING OUT THE INVENTION

Figure 1:
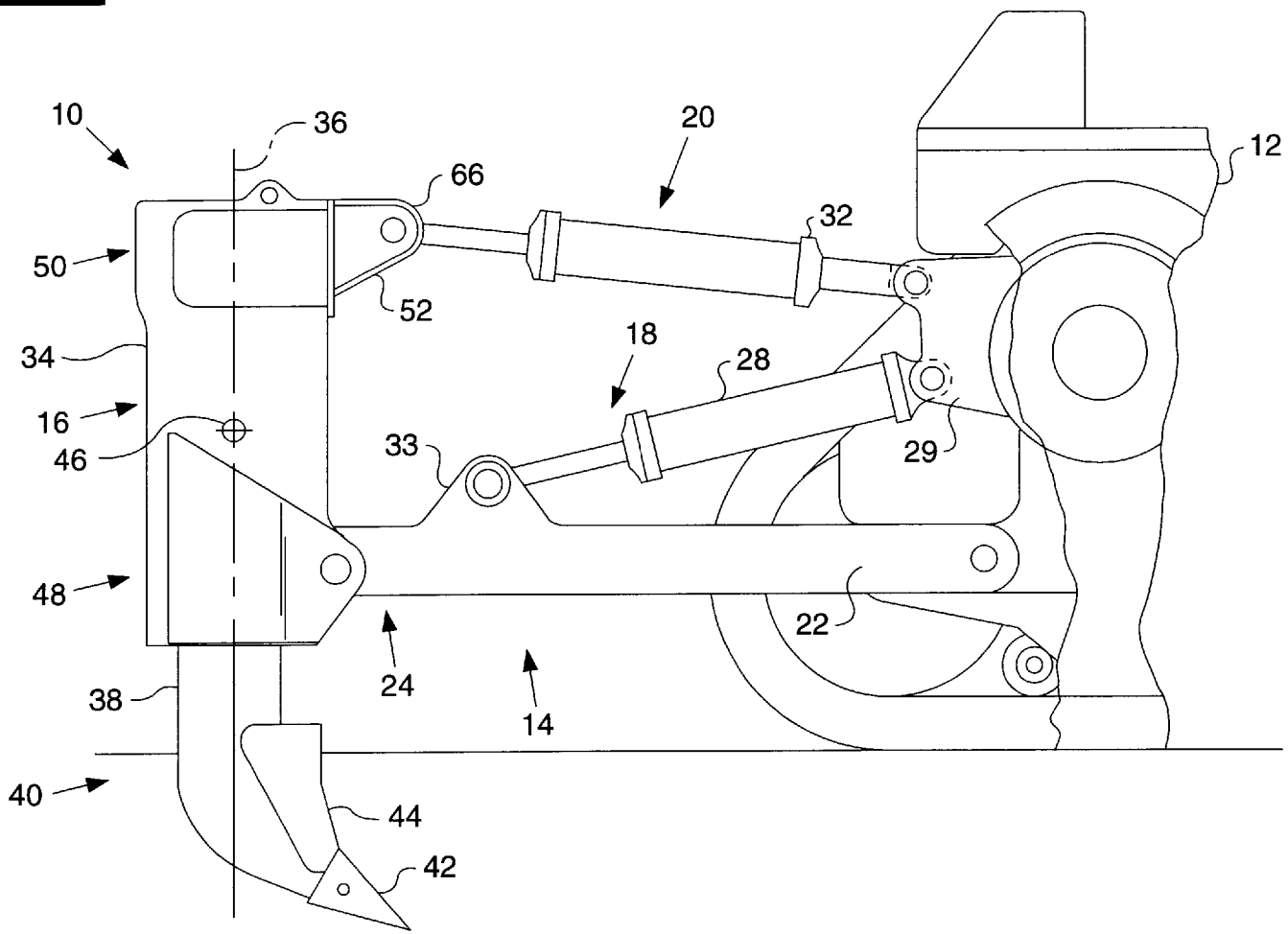
FIG. 1 is a diagrammatic representation of a side view of a ripper assembly incorporating an embodiment of the present invention.

Referring to FIG. 1 of the drawings, a ripper assembly 10 is shown attached to a vehicle 12. The ripper assembly 10 includes a frame assembly 14, a ripper carriage assembly 16, a lift mechanism 18, and a pitch control mechanism 20.

The frame assembly has a first end 22 pivotally connected to the frame of the vehicle 12 and a second end 24 spaced from the first end 22 and pivotally connected to the ripper carriage assembly 16. The lift mechanism 18 includes a pair of hydraulically operated cylinders 26, 28 extending between pivot brackets attached to the frame of the vehicle 12 and pivot brackets 33 mounted on a portion of the frame assembly 14 spaced from the vehicle 12. By extending the hydraulic lift cylinders 26, 28, the second end 24 of the frame assembly 14 is lowered. The second end of the frame assembly 14 is raised in response to retracting the lift cylinders 26, 28.

The pitch control mechanism 20 includes a pair of hydraulic cylinders 30, 32 respectively having first end pivotally attached to the bracket 29 mounting on the frame of the vehicle 12 and opposite ends pivotally connected to an upper portion of the ripper carriage assembly 16, in a manner described below in greater detail.

Figure 2:
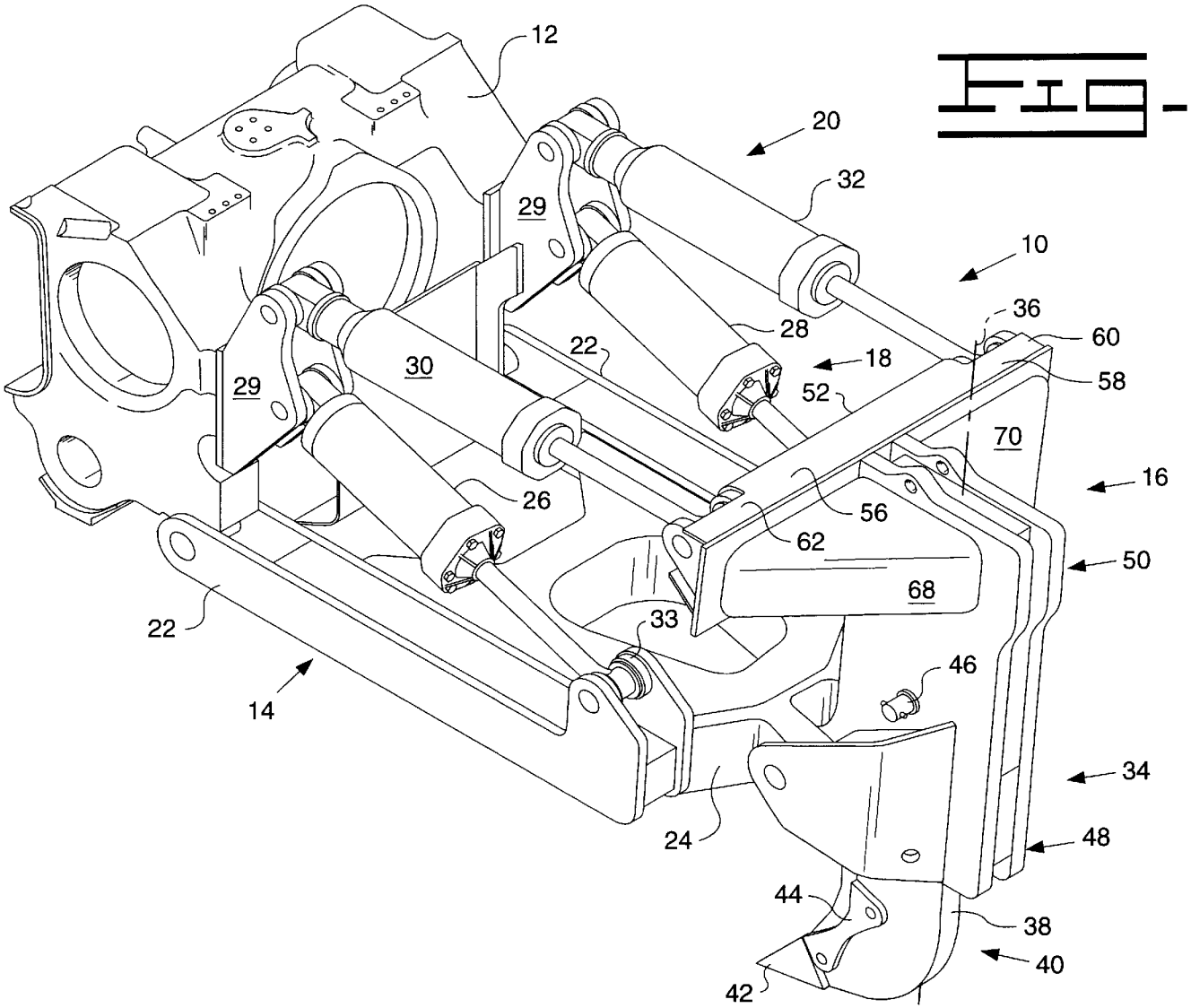
FIG. 2 is a three-dimensional view of the ripper assembly embodying the present invention.
Figure 3:
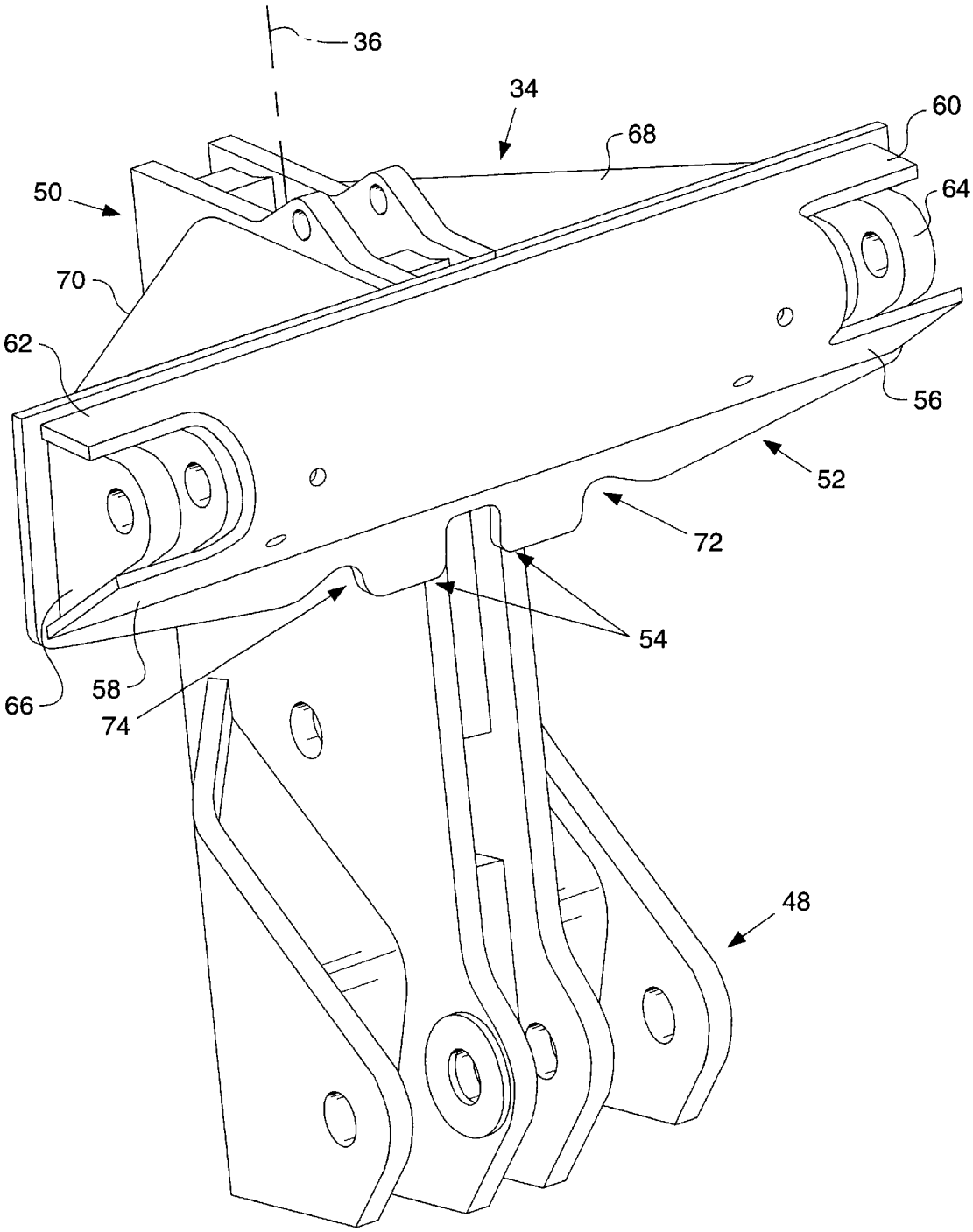
FIG. 3 is a three-dimensional view of a ripper implement support housing embodying the present invention.

In the preferred embodiment of the present invention illustrated in the drawings and described herein, the ripper carriage assembly 16 includes an elongated ripper implement support housing 34, as best shown in FIGS. 2 and 3, having a predefined longitudinal axis 36. The ripper implement support housing is adapted to receive a shank portion 38 of a ripper implement 40 that has a ripper tip 42 and a shank protector 44 mounted on a lower portion of the shank 38. A pin 46 extends through the sides of the ripper implement support housing 34 and the shank portion 38 of the ripper implement 40, and secures the ripper implement 40 within the ripper implement support housing 34 during operation.

The ripper implement support housing 34 has a first, or lower, end portion 48 that is pivotally connected to the second end 24 of the frame assembly 14, and a second, or upper, end portion 50 spaced from the first end portion 48. The ripper carriage assembly 16 includes a transverse cross beam 52 that is spaced from the longitudinal axis 36 of the ripper implement support housing and extends in a direction transverse to the longitudinal axis 36, as illustrated in FIGS. 2 and 3,. As best illustrated in FIG. 3, a central portion 54 of the transverse cross beam 52 is rigidly attached, such as by a weldment, to the second end of portion 50 of the ripper implement support housing 34. The transverse cross beam 52 has a pair of arms 56, 58 extending outwardly from the central portion 52 which have respective spaced apart distal end portions 60, 62. Each of the end portions 60, 62 have a respective pivot bracket 64, 66 mounted thereon that are adapted to respectively receive the distal ends of the hydraulic cylinders 30, 32 of the pitch control mechanism 20. A pair of filet structures 68, 70 are fixedly disposed between each of the arms 56, 58 and the respective side wall of the support housing 34.

Importantly, in the preferred embodiment of the present invention, the transverse cross beam 52 has a pair of stress relief notches 72, 74 extending inwardly from a bottom surface of the transverse cross beam 52 at a position between the respective distal end portions 60, 62 of the arms 56, 58 and the central portion 54 of the transverse cross beam 52. The stress relief notches 72, 74 provide a reduced cross sectional area of the transverse cross beam 52 between the point at which the respective hydraulic cylinders 30, 32 are attached to the transverse cross beam 52 and the rigidly attached central portion 54 of the transverse cross beam 52.

The reduced cross sectional area serves a dual purpose. A first function of the stress relief notches 72, 74 is to prevent a direct transmission path for stresses to be transferred between the distal end portions 60, 62 of the arms 56, 58 and the rigid attachment, i.e., the weld joint, of the transverse cross beam 52 to the support housing 34. In prior ripper structures, when the tip of the ripper was deflected sideways, thereby producing a torque force generally centered about the longitudinal axis 36, the torque force was transmitted to the attachment points of the pitch control cylinders 30, 32. Repeated applications of the twisting shock loads on the ripper tip 42 could cause failure of the welded joints in the structure. In the ripper assembly 10 embodying the present invention, the presence of stress relief notches 72, 74 interposed between the welded joint securing the central portion 54 of the transverse cross beam 52 to the support housing 34 and the distal end portions 60, 62 of the arms 56, 58, redirects force-induced stresses away from the weldment.

Additionally, the stress relief notches 72, 74 enable the arms 56, 58 to act in a manner somewhat similar to that of cantilevered beams in that they are capable of limited deflection as a result of a reduced cross sectional area provided by the stress relief notches 72, 74. Consequently when deflected, the arms 56, 58 are able to act as beams having a limited deflection, and are able to store at least a portion of the energy causing the deflection. Thus, as the ripper tip 42 attempts to twist sideways, producing a torque force transmitted to the distal ends 60, 62 of the arms 56, 58, the arms Sg, SS are stressed and consequently produce a force counter to the direction of twist. Importantly, a portion of the counterforce is transmitted back to the ripper tip 42 instead of being concentrated at the rigid weldment between the central portion 54 of the transverse cross beam 52 in the support housing 34.

INDUSTRIAL APPLICABILITY

In the operation of the vehicle 12 with a ripper assembly 10 embodying the present invention, the transverse cross beam 52, with stress relief notches 72, 74, provides a the transverse beam 52 that permits the ripper carriage assembly to store a portion of the energy produced by off-center deflection, or twisting, of the ripper tip 42. The stored energy produces a counterforce, urging the ripper tip 42 back to its center, or straight ahead, position. This not only produces more efficient ripping operation, but also reduces the amount of stress transmitted to the rigid attachment point of the cross beam 52 to the ripper implement support housing 34. Thus, not only is energy stored and returned to the ripper tip 42, but the integrity of the ripper assembly 10 is also maintained over a longer period of time due to less frequent failure of welded joints. In view of the foregoing, it is readily apparent that the ripper assembly 10, embodying the present invention provides an energy storing device that enhances ripping operation and increases the service life of the assembly.

Other aspects, objects, and advantages of this invention can be obtained from a study of the drawings, the disclosure, and the appended claims.

What is claimed is:

1. In a vehicle having a ripper assembly moveably disposed on said vehicle and comprising.

a frame assembly having a first end pivotally attached to said vehicle and a second end spaced from said first end;

a lift mechanism disposed between said vehicle and said second end of the frame assembly;

a ripper carriage assembly having an elongated ripper implement support housing adapted to receive the shank of a ripper implement therein, a first end portion of said support housing being pivotally connected to the second end of said frame assembly, and a second end portion spaced from said first end portion; and a pitch control mechanism disposed between said vehicle and said ripper carriage assembly;

wherein said ripper carriage assembly further includes a transverse cross beam having a central portion rigidly mounted on the second end portion of said support housing, and a pair of arms extending outwardly from said central portion, each of said arms having a distal end portion having a bracket mounted thereon which provides an attachment point for a pivot connection between the pitch control mechanism and the ripper carriage assembly, and a stress relief notch disposed between said central portion of the transverse cross beam and each of the distal end portions of the arms extending outwardly from the central portion of the transverse cross beam.

2. The vehicle, as set forth in claim 1, wherein said transverse cross beam of the ripper carriage assembly is braced by a filet structures fixedly disposed between each of the arms extending outwardly from the central portion of the transverse cross beam and a sidewall of the ripper implement support housing.

3. The vehicle as set forth in claim 1, wherein the first end portion of the ripper implement support housing is disposed at a position elevationally below that of the second end portion of the ripper implement support housing.

4. A ripper carriage assembly, comprising:

a ripper implement support housing having a predefined longitudinal axis, a first end portion to a frame assembly, and a second end portion spaced from the first end portion; and a transverse cross beam spaced from said longitudinal axis of the support housing and extending in a direction transverse to said longitudinal axis, said transverse cross beam having a central portion rigidly mounted on the second end portion of the support housing, a pair of arms extending respectively outwardly from said central portion, each of said arms having distal ends spaced from said central portion, and stress relief notches formed in each of said arms at a position between the respective distal ends of the arms and the central portion of the transverse cross beam.

5. The ripper carriage assembly, as set forth in claim 4, wherein the distal ends of the arms have a bracket mounted thereon adapted to provide a pivot connection between the transverse cross beam of the ripper carriage assembly and a predefined pitch control mechanism.

6. The ripper carriage assembly, as set forth in claim 4, wherein the transverse cross beam is braced by a filet structure fixedly disposed between each of the arms extending outwardly from the central portion of the transverse cross beam and a sidewall of the ripper implement support housing.

* * * * *